US008176816B2

(12) United States Patent
Simon

(10) Patent No.: US 8,176,816 B2
(45) Date of Patent: May 15, 2012

(54) WRENCH

(76) Inventor: David A. Simon, Harrison Township, MI (US)

( * ) Notice: Subject to any disclaimer, the term of this patent is extended or adjusted under 35 U.S.C. 154(b) by 434 days.

(21) Appl. No.: 11/448,600

(22) Filed: Jun. 7, 2006

(65) Prior Publication Data

US 2006/0260442 A1 Nov. 23, 2006

Related U.S. Application Data

(62) Division of application No. 10/435,225, filed on May 9, 2003, now Pat. No. 7,059,221.

(51) Int. Cl.
*B25B 13/16* (2006.01)

(52) U.S. Cl. ..... 81/165; 81/170

(58) Field of Classification Search ..... 81/165, 81/177.2, 170, 57.22, 63.1, 164, 167
See application file for complete search history.

(56) References Cited

U.S. PATENT DOCUMENTS 592,031 A * 10/1897 Waitt ..... 81/170
1,145,597 A * 7/1915 Kopacki ..... 81/170
1,309,727 A 7/1919 Greig et al.
1,326,391 A 12/1919 Church
1,352,354 A 9/1920 Church
1,356,565 A 10/1920 Slagle et al.
1,409,554 A 3/1922 Kitterman
1,417,390 A * 5/1922 Krumsick ..... 81/170
1,493,741 A * 5/1924 Ellison ..... 81/170
1,563,883 A 12/1925 Waters
1,929,258 A * 10/1933 Petersen et al. ..... 81/164
1,931,559 A * 10/1933 Segal ..... 81/170
2,500,835 A 3/1950 Lang
2,610,534 A * 9/1952 Shaff ..... 81/370
3,035,467 A * 5/1962 Pirtle ..... 81/170
3,046,821 A * 7/1962 Legris ..... 81/164
3,891,185 A * 6/1975 Lett ..... 81/170
3,905,256 A * 9/1975 Foley ..... 81/165
5,363,727 A 11/1994 Barth et al.
5,732,992 A * 3/1998 Mauldin ..... 294/119.1
5,862,722 A 1/1999 Cislo
6,223,632 B1 * 5/2001 Johnson ..... 81/167
6,272,952 B1 8/2001 Hsu et al.
6,272,953 B1 * 8/2001 Kant ..... 81/461
6,282,996 B1 * 9/2001 Berg et al. ..... 81/427.5
6,349,621 B1 2/2002 Khachatoorain
6,408,721 B1 6/2002 Lee
6,421,896 B1 * 7/2002 Beyer ..... 29/213.1
6,665,919 B1 * 12/2003 Kurtz et al. ..... 29/262
7,059,221 B2 * 6/2006 Simon ..... 81/164
2004/0221690 A1 * 11/2004 Simon ..... 81/164
2006/0260442 A1 * 11/2006 Simon ..... 81/164

* cited by examiner

*Primary Examiner* — Lee D. Wilson
(74) *Attorney, Agent, or Firm* — Carlson, Gaskey & Olds, P.C.

(57) ABSTRACT

A wrench includes a wrench head mounted on an end of a handle. A handle of the wrench includes a fixed portion and a rotatable portion. Rotation of the rotatable portion of the handle causes movement of at least one contact surface of the wrench head. In one embodiment, rotation of the rotatable portion provides adjustment or movement of one of the jaws of the wrench head relative to another jaw of the wrench head. In another embodiment, rotation of the rotatable portion provides rotation of the wrench head. The rotatable portion of the handle is slidably mounted within the fixed portion of the handle, such that rotatable portion can be selectively extended to provide additional leverage on the wrench.

30 Claims, 5 Drawing Sheets

WRENCH

This application is a Divisional of U.S. patent application Ser. No. 10/435,225, filed on May 9, 2003 now U.S. Pat. No. 7,059,221.

BACKGROUND OF THE INVENTION

The present invention relates generally to wrenches and more particularly to adjustable wrenches.

There are many types of wrenches that provide for adjustment of the distance between two jaws, including pipe wrenches and crescent wrenches. These adjustable wrenches typically provide an adjustment mechanism near the wrench head, such as a rotatable collar or worm gear. This can be inconvenient when using the wrench in tight spaces where the user's hand cannot reach the adjustment mechanism while the wrench is in place.

Ratchet wrenches are also difficult to use in tight places. Sometimes there is insufficient space for pivoting the handle of the wrench to turn the nut or bolt. One previously proposed solution is a wrench that includes two spaced-apart handle members, which when squeezed together cause rotation of the wrench head. However, in certain situations there may not even be enough room for operation of this wrench.

One type of pipe wrench includes a slidable tab connected to the upper jaw. In order to facilitate re-positioning of the wrench on the object, the user can retract the upper jaw by pulling back the tab on the wrench. Again, this mechanism is located on the wrench head, which may be inconvenient in tight work areas.

With any type wrench and with pipe wrenches in particular, the user occasionally requires more leverage than the existing handle provides. In those situations, users often resort to inserting the end of the wrench handle into an end of a pipe. The pipe provides additional leverage on the wrench handle; however, an extra pipe is not always available when needed.

SUMMARY OF THE INVENTION

The present invention provides a wrench that provides for adjustment or operation of the wrench head based upon rotation of a portion of the handle away from the wrench head. The wrench has a handle with a rotatable portion rotatably mounted within a fixed portion and a wrench head including at least one contact surface for contacting an object, such as a pipe, fitting, nut or bolt. In the present invention, rotation of the rotatable portion of the handle relative to the fixed portion of the handle causes movement of the contact surface relative to the fixed portion of the handle.

In one embodiment, the contact surface is a surface on one of a pair of opposed jaws and the movement of one of the jaws selectively adjusts the distance between the jaws. In another embodiment according to the present invention, rotation of the rotatable portion of the handle causes rotation of the wrench head, which rotates the object. In yet another embodiment according to the present invention, rotation of the rotatable portion of the handle opens the jaws of a pipe wrench, to release the pipe wrench from the pipe.

In another feature according to the present invention, the rotatable portion of the handle is slidably received within the fixed portion of the handle in a telescoping manner. As a result, when the user needs additional leverage on the wrench, the rotatable portion of the handle can be extended, thereby providing additional leverage on the wrench handle while still maintaining the ability to provide adjustment or rotation of the wrench head in any of the embodiments described herein.

BRIEF DESCRIPTION OF THE DRAWINGS

The various features and advantages of this invention will become apparent to those skilled in the art from the following detailed description of the currently preferred embodiments. The drawings that accompany the detailed description can be briefly described as follows.

DETAILED DESCRIPTION OF PREFERRED EMBODIMENTS

Figure 1:
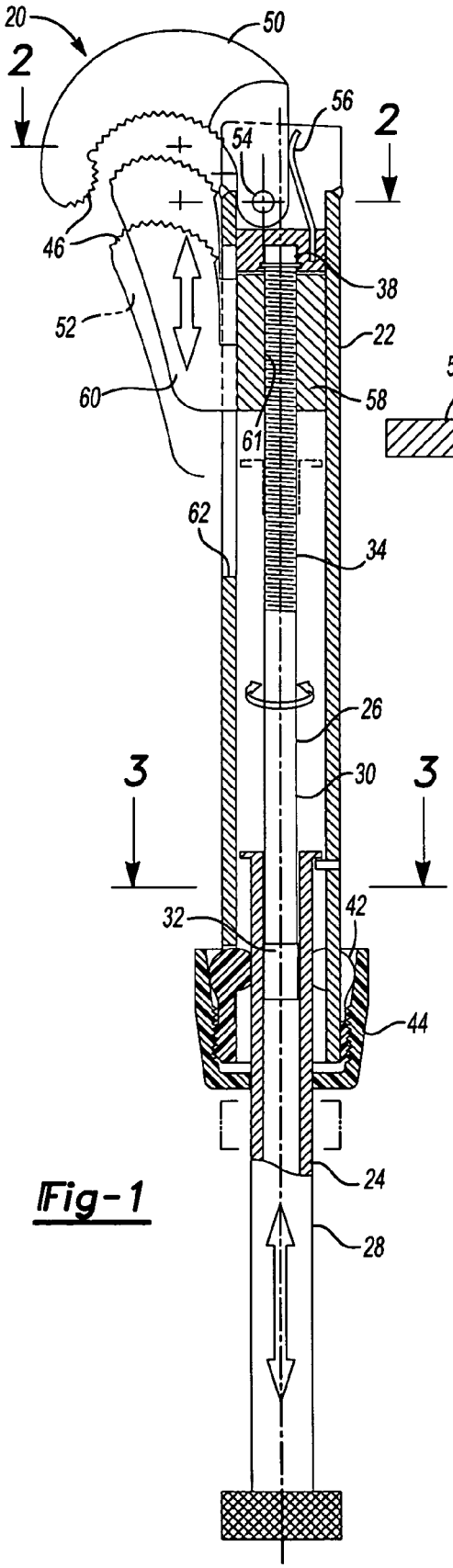
FIG. 1 is a sectional view of an adjustable wrench according to a first embodiment of the present invention.

An adjustable wrench 20 according to the first embodiment of the present invention is shown in FIG. 1. The adjustable wrench 20 in FIG. 1 is a pipe wrench 20 including a handle having a fixed portion 22 and a rotatable portion 24 rotatably and slidably mounted within the fixed portion 22. A rod 26 is rotatably mounted within the fixed portion 22 of the handle and slides within the rotatable portion 24. The rod 26 includes a generally cylindrical portion 30 having a square or otherwise non-circular portion 32. The rod 26 further includes a threaded portion 34 at an upper end. An upper end 38 of the rod 26 is rotatably journaled in an upper end of the fixed portion 22 of the handle.

The rod 26 is non-rotatably fixed to the rotatable portion 24 of the handle by the square portion 32 of the rod 26. However, the rotatable portion 24 of the handle is slidable axially relative to the rod 26 and the fixed portion 22 of the handle.

A plurality of rubber flanges 42 are positioned inside an end cap 44 that is threadably mounted on a lower end of the fixed portion 22 of the handle. The rubber flanges 42 selectively prevent sliding and rotation of the rotatable portion 24 of the handle relative to the fixed portion 22 when the end cap 44 is tightened on the fixed portion 22 of the handle.

A wrench head 46, including an upper jaw 50 and a lower jaw 52, is mounted to an upper end of the fixed portion 22 of the handle. The upper jaw 50 is pivotably mounted via a pin 54 through the fixed portion 22 of the handle. The upper jaw 50 is spring biased toward the lower jaw 52 by a spring 56 fixed to the fixed portion 22 of the handle. The lower jaw 52 includes a generally cylindrical portion 58 and a jaw portion 60. The cylindrical portion 58 has an inner threaded bore 61 through which the threaded portion 34 of the rod 26 is threadably received. The cylindrical portion 58 of the lower jaw 52 is slidable inside the fixed portion 22 of the handle. The jaw portion 60 of the lower jaw 52 protrudes outward through an elongated opening 62 in the side of the fixed portion 22 of the handle.

Figure 2:
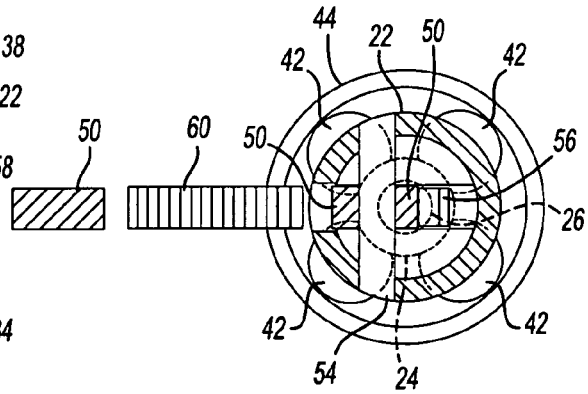
FIG. 2 is a sectional view along lines 2-2 of FIG. 1.

FIG. 2 is a sectional view through lines 2-2 of FIG. 1. As can be seen in FIG. 2, the rotatable portion 24 of the handle telescopes within the fixed portion 22 of the handle, while the rod 26 telescopes within the rotatable portion 24.

Figure 3:
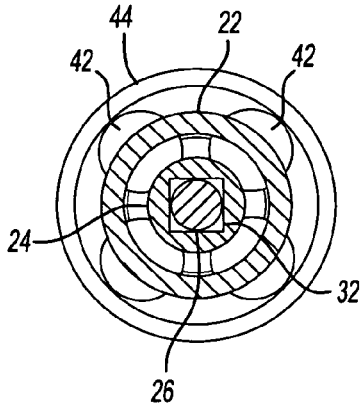
FIG. 3 is a sectional view taken along lines 3-3 of FIG. 1.

As can be seen in FIG. 3, the square portion 32 of the rod 26 engages the rotatable portion 24 of the handle, such that rotation of the rotatable portion 24 causes rotation of the rod 26 within the fixed portion 22 of the handle.

In operation, referring to FIG. 1, the wrench head 46 can be adjusted by rotating the rotatable portion 24 of the handle relative to the fixed portion 22 of the handle. The rotatable portion 24 of the handle engages the square portion 32 of the rod 26, which transmits the rotation to the rod 26. Rotation of the threaded portion 34 of the rod 26 causes translation of the lower jaw 52 toward or away from the upper jaw 50 to the location desired by the user.

The wrench 20 can then be used to turn a pipe, fitting or other object. If additional leverage is necessary, the rotatable portion 24 can be telescoped outwardly from the fixed portion 22 of the handle to extend the overall length of the handle. When the rotatable portion 24 is in the desired position, it is locked in place by rotation of the end cap 44.

Figure 4:
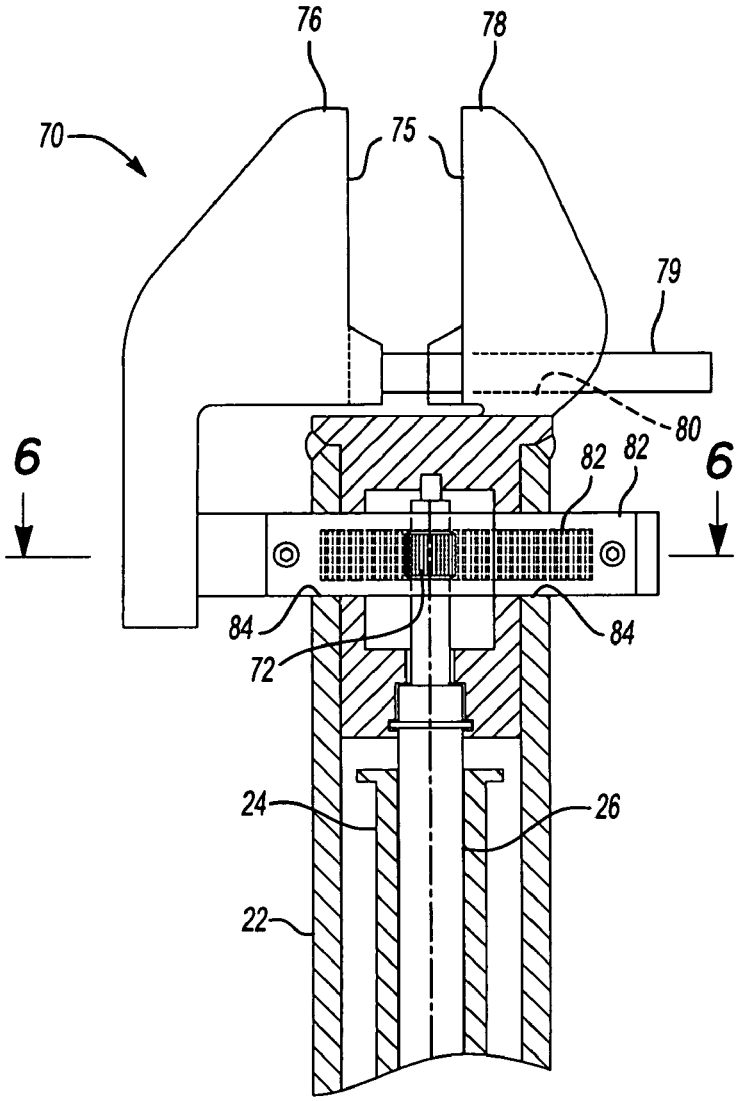
FIG. 4 is a partial sectional side view of an adjustable wrench according to a second embodiment of the present invention.

An adjustable wrench 70 according to a second embodiment to the present invention is shown in FIG. 4. The adjustable wrench 70 includes the fixed portion 22 and the rotatable portion 24 of the handle and the rod 26 which operate in the same manner relative to one another as described above with respect to FIG. 1. As in all of the embodiments described herein, the rotatable portion 24 of the handle telescopes within the fixed portion 22 of the handle and is non-rotatably fixed to the rod 26. However, in this embodiment, rotation of the rotatable portion 24 of the handle causes rotation of a pinion gear 72 extending axially from an inner end of the rod 26.

A wrench head 75 includes a lower jaw 76 is moveable toward and away from an upper jaw 78 fixed to the fixed portion 22 of the handle. The lower jaw 76 includes a guide rod 79 extending slidably into a guide channel 80 through the upper jaw 78. The lower jaw 76 further includes a rack 81 and a parallel guide 82 extending slidably through openings 84 through the fixed portion 22 of the handle. Inside the fixed portion 22 of the handle, the rack 81 engages the pinion gear 72.

Figure 5:
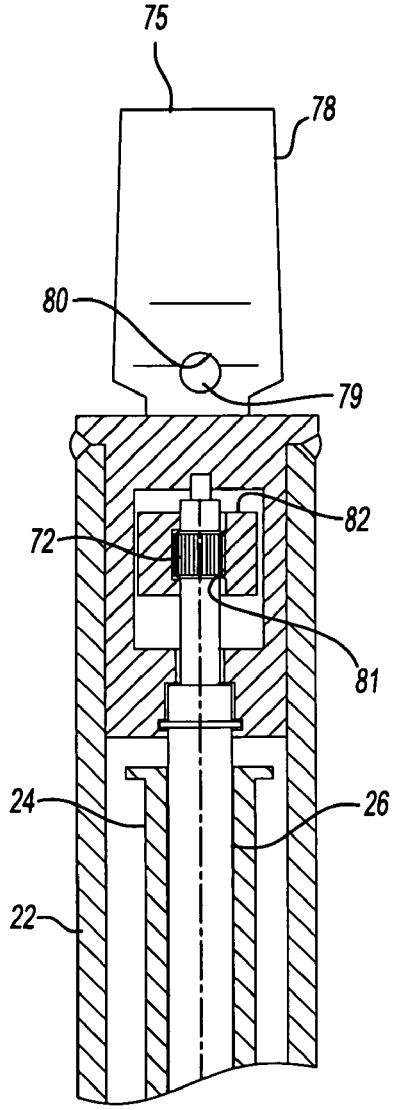
FIG. 5 is a partial sectional bottom view of the wrench of FIG. 4.
Figure 6:
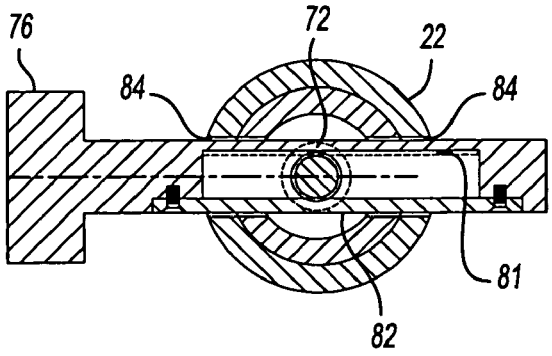
FIG. 6 is a sectional view taken along lines 6-6 of FIG. 4.

As can be seen in FIGS. 5 and 6, the pinion gear 72 is positioned between the rack 81 and parallel guide 82. The parallel guide 82 maintains the pinion gear 72 in engagement with the rack 81.

Referring to FIG. 4, in operation, rotation of the rotatable portion 24 of the handle causes gear 72 to engage rack 81 to move lower jaw 76 toward and away from upper jaw 78, thereby providing adjustment of the wrench head 75. As described above, if additional leverage is desired, the rotatable portion 24 of the handle can be telescoped out of the fixed portion 22 of the handle to extend the overall length of the handle.

Figure 7:
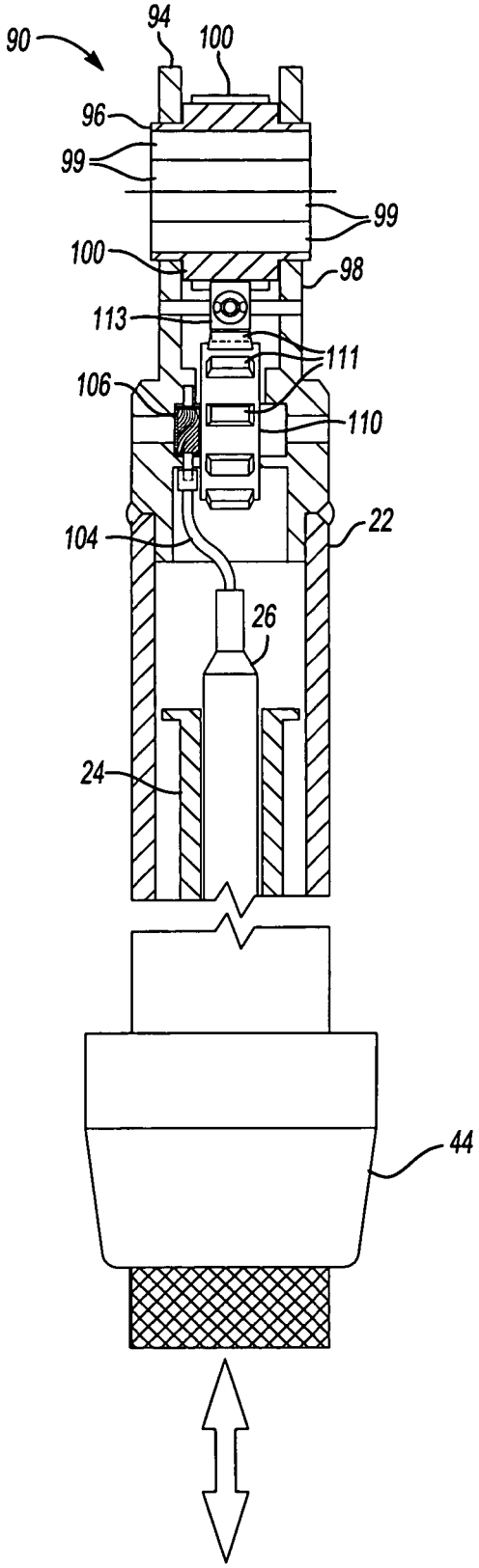
FIG. 7 is a sectional, side view of a wrench according to a third embodiment of the present invention.

FIG. 7 illustrates a wrench 90 according to a third embodiment of the present invention. The wrench 90 includes the fixed portion 22 and rotatable portion 24 of the handle and the rod 26 which is non-rotatably fixed to the rotatable portion 24. The rotatable portion is slidable axially relative to the fixed portion 22 of the handle and the rod 26. In the wrench 90, a wrench head 94 includes a box end 96 rotatably mounted within a housing 98. The box end 96 includes a plurality of contact surfaces 99 on an interior circumference of the box end 96. A plurality of tapered teeth 100 extend around an exterior periphery of the box end 96. A flexible cable 104 extends from an inner end on the rod 26 and transmits rotation from the rod 26 to a gear 106 rotatably mounted in the housing 98 of the wrench head 94.

Figure 8:
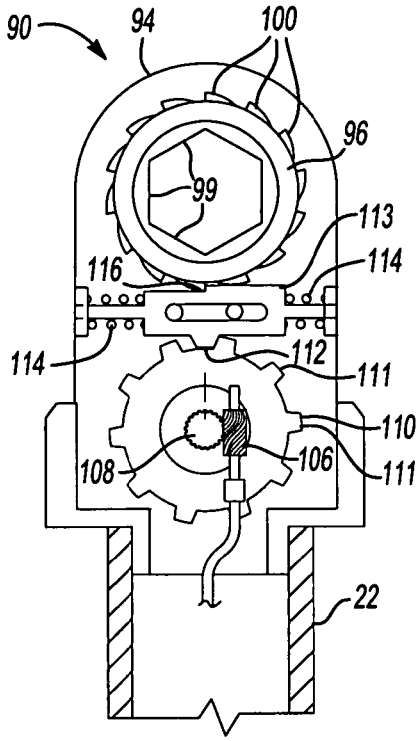
FIG. 8 is a front, sectional view of the wrench of FIG. 7.

Referring to FIG. 8, the gear 106 engages a small pinion gear 108 fixedly mounted concentrically to a larger gear 110. Teeth 111 on the larger gear 110 engage a tab 112 on an indexer 113 which is mounted on springs 114 between the larger gear 110 and the box end 96. The indexer 113 further includes an indexing surface 116 opposite the tab 112. The indexing surface 116 engages the tapered teeth 100 on the box end 96. In operation, rotation of the rotatable portion 24 imparts rotation through the rod 26, flexible cable 104 and gear 106. Rotation of the gear 106 rotates pinion gear 108 and larger gear 110. The teeth 111 on the larger gear 110 repeatedly cause the indexer 113 to move laterally, such that indexing surface 116 engages the tapered teeth 100 to cause box end 96 to rotate. As each tooth 111 passes by tab 112, the indexer 113 is spring-returned back to its initial position, where it engages the next tooth 100 on the box end 96. In this manner, rotation of the rotatable portion 24 of the handle can be used to rotate the box end 96 and a nut or bolt engaged by box end 96.

Alternatively, the wrench 90 can be used as a normal ratchet wrench, where rotation of the fixed portion 22 of the handle about the nut or bolt in one direction causes rotation of the box end 96, while rotation of the fixed portion 22 of the handle in the opposite direction does not permits the tapered teeth 100 to slide by the teeth 111 of the larger gear 110. Again, in this embodiment, the rotatable portion 24 of the handle can be telescoped outwardly to extend the overall length of the handle for additional leverage.

Figure 8A:
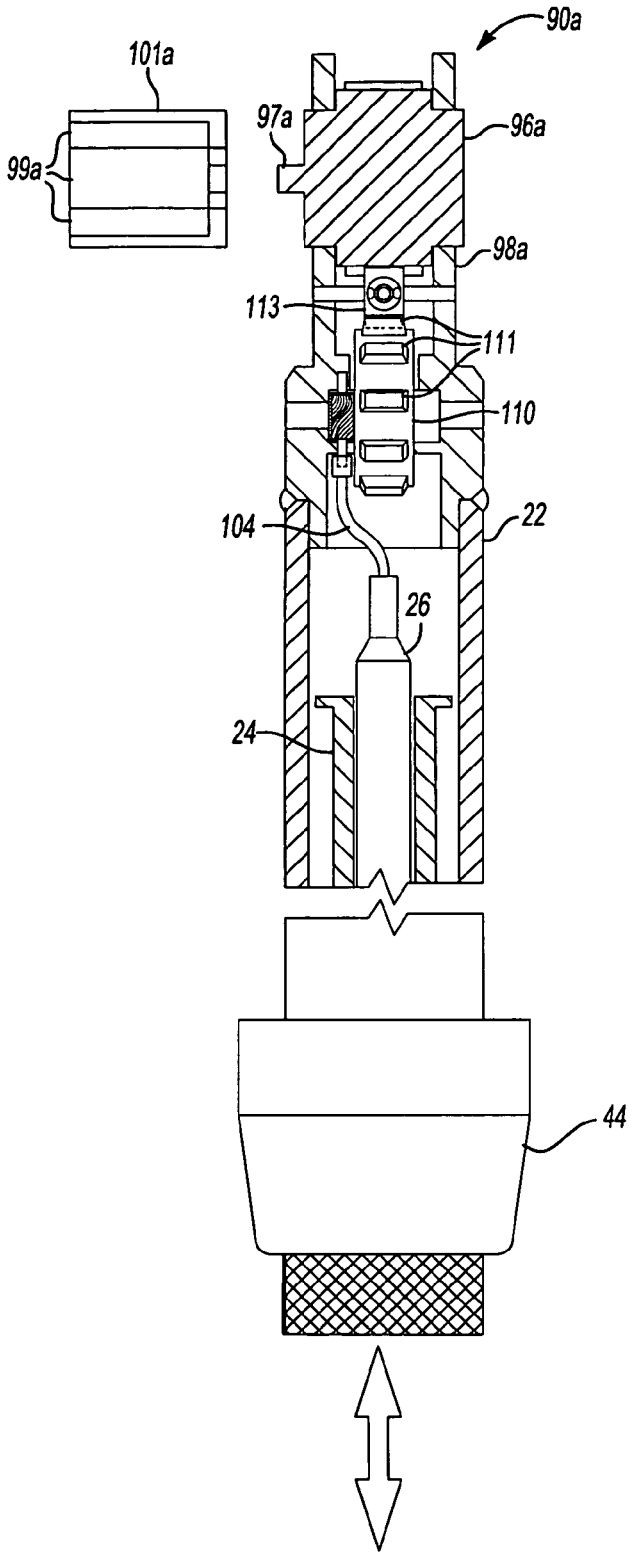
FIG. 8A is a sectional, side view of a wrench according to a fourth embodiment of the present invention.

FIG. 8A illustrates a wrench 90*a* according to a fourth embodiment of the present invention. The wrench 90*a* is similar to the wrench 90 of FIG. 8, and identical components are numbered identically. The wrench 90*a* is a socket wrench 90*a*, having a rotating component 96*a* from which a square stud 97*a* extends. The stud 97*a* selectively engages any one of a plurality of sockets 101*a* (only one shown) having interior contact surfaces 99*a*. In the wrench 90*a*, rotation of the rotatable portion 24 of the handle causes rotation of the component 96*a* and the socket 101*a*.

Figure 9:
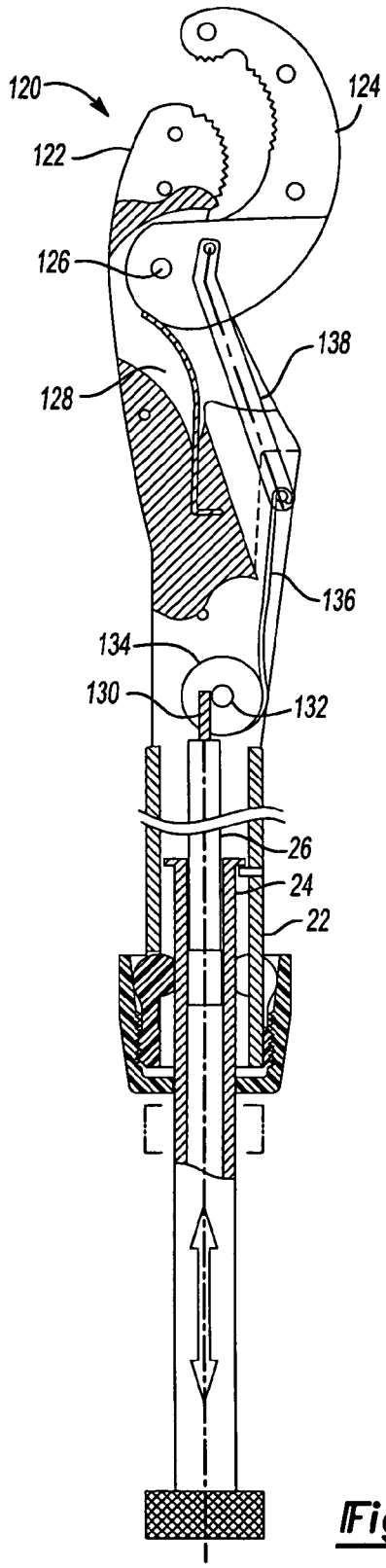
FIG. 9 is a partial sectional view of an adjustable wrench according to a fifth embodiment of the present invention.
Figure 10:
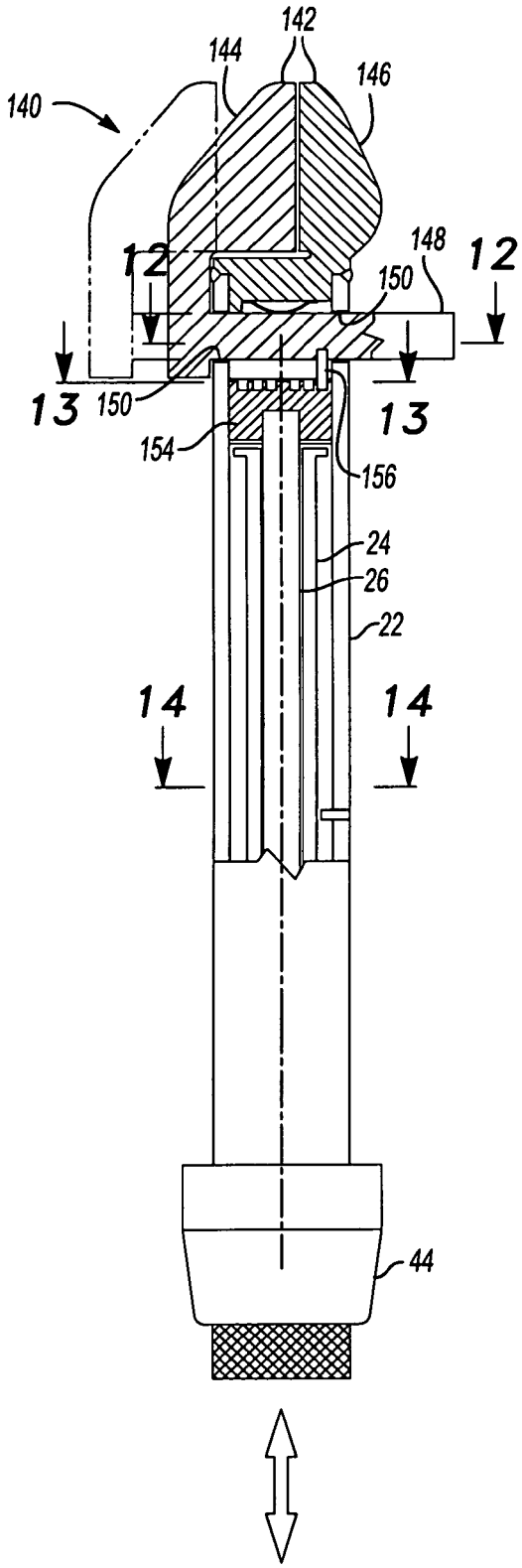
FIG. 10 is a sectional side view of a wrench according to a sixth embodiment of the present invention.
Figure 11:
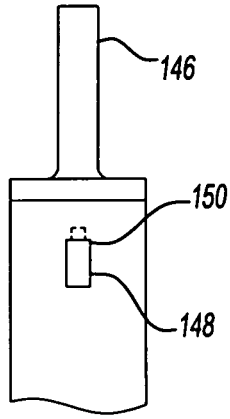
FIG. 11 is a bottom view of the wrench of FIG. 10.
Figure 12:
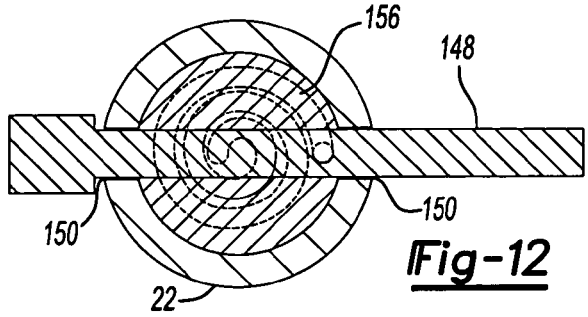
FIG. 12 is a sectional view along lines 12-12 of FIG. 10.
Figure 13:
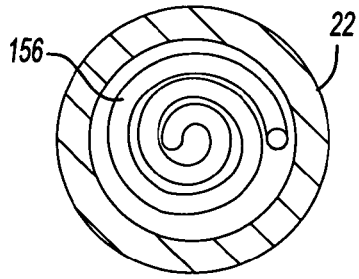
FIG. 13 is a sectional view along lines 13-13 of FIG. 10.
Figure 14:
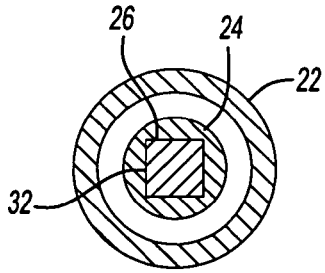
FIG. 14 is a sectional view along lines 14-14 of FIG. 10.

FIG. 9 illustrates a wrench 120 according to a fifth embodiment of the present invention. Again the wrench 120 includes the rod 26 and the fixed and rotatable portions 22, 24 of the handle, which operate relative to one another as described above. The wrench 120 includes a lower jaw 122 fixedly secured to the fixed portion 22 of the handle. An upper jaw 124 is mounted to the lower jaw 122 and fixed portion 22 of the handle at a pivot point 126. The upper jaw 124 is biased toward the lower jaw 122 by a spring 128.

In this embodiment, a gear 130 extends from an inner end of the rod 26 to engage a small pinion gear 132 fixedly mounted at the center of a larger pulley 134. An outer circumference of the pulley 134 is secured to a cable 136 connected to linkage 138, which in turn is secured to the upper jaw 124 upwardly of the pivot point 126. In operation, rotation of the rotatable portion 24 of the handle causes rotation of the gears 130, 132 and pulley 134, which in turn retracts cable 136 and linkage 138 causing movement of the upper jaw 124 away from the lower jaw 122. Again, the rotatable portion 24 of the handle can be telescoped outwardly of the fixed portion 22 of the handle for additional leverage if necessary.

FIGS. 10-14 illustrate a wrench 140 according to a sixth embodiment of the present invention implementing the rod 26 and the fixed and rotatable portions 22, 24 of the handle as described above. The wrench 140 includes a wrench head 142 including a lower jaw 144 movable toward and away from an upper jaw 146. The lower jaw 144 includes a guide 148 slidably extending through openings 150 through the fixed portion 22 of the handle. In this embodiment, the inner end of the rod 26 is secured to a plug 154 rotatably mounted within the fixed portion 22 of the handle. The plug 154 is secured to one end of a scroll 156, while the opposite end of the scroll 156 is attached to the guide 148.

In operation, rotation of the rotatable portion 24 of the handle imparts rotation to rod 26 which rotates plug 154 and winds or unwinds scroll 156, thereby causing the lower jaw 144 to move toward or away from the upper jaw 146 to provide adjustment of the wrench head 142. In this wrench 140 again, the rotatable portion 24 of the handle is extendable to provide additional leverage to the wrench 140.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. As shown above, the present invention is applicable to many different types of wrenches, including those not specifically disclosed here.

What is claimed is:

1. A wrench comprising:

a handle having a fixed portion and a rotatable portion, the rotatable portion rotatable about an axis through the handle;

a first jaw mounted to the handle;

a second jaw mounted to the handle, rotation of the rotatable portion of the handle causing relative movement between the first jaw and second jaw toward or away from one another, wherein the first jaw is pivotably mounted at a pivot point relative to the fixed portion of the handle and wherein the rotatable portion of the handle is mechanically coupled to a point spaced away from the pivot point, such that rotation of the rotatable portion of the handle causes pivoting movement of the first jaw relative to the fixed portion of the handle.

2. The wrench of claim 1 further including a threaded portion coupled to the rotatable portion, the threaded portion threadably engaging at least one of the first jaw and the second jaw.

3. The wrench of claim 2 wherein the rotatable portion is movable axially along the axis to selectively extend the handle.

4. The wrench of claim 3 wherein the rotatable portion of the handle is slidable along the axis to selectively extend the handle.

5. The wrench of claim 4 wherein the rotatable portion of the handle is coupled to the threaded portion such that rotation of the rotatable portion causes rotation of the threaded portion, rotation of the threaded portion causing movement of at least one of the first and the second jaw.

6. The wrench of claim 5 wherein the second jaw is slidably mounted on the fixed portion of the handle, the second jaw including threads engaging threads on a threaded rod rotatably driven by the rotatable portion of the handle.

7. The wrench of claim 6 wherein the fixed portion of the handle includes an opening through which the threads on the second jaw engage the threads on the threaded rod.

8. The wrench of claim 1 wherein a moveable one of the first and second jaws is slidably mounted on the handle fixed portion.

9. The wrench of claim 1 wherein the rotatable portion threadably engages a moveable one of the first and second jaws.

10. The wrench of claim 1 wherein a moveable one of the first and second jaws translates relative to the rotatable handle portion based upon rotation of the rotatable handle portion.

11. The wrench of claim 1 wherein the wrench is a pipe wrench.

12. The wrench of claim 1 wherein the rotatable portion of the handle is rotatable about a first axis and wherein the relative movement between the first and second jaw is in a direction generally perpendicular to the first axis.

13. The wrench of claim 12 further including a gear rotating based upon rotation of the rotatable portion, the gear engaging a rack connected to the first jaw to cause movement of the first jaw relative to the second jaw and the fixed portion of the handle.

14. A wrench comprising:

a handle having a fixed portion and a rotatable portion rotatable about a first axis relative to the fixed portion, the rotatable portion also translatable along the first axis relative to the fixed portion to selectively extend and retract the handle; and a wrench head including at least one contact surface, rotation of the rotatable portion of the handle relative to the fixed portion of the handle causing rotational movement of the at least one contact surface relative to the fixed portion of the handle completely about a second axis transverse to the first axis.

15. The wrench of claim 14 further including a flexible cable mechanically interposed between the rotatable portion and the at least one contact surface.

16. A wrench comprising:

a handle having a fixed portion and a rotatable portion coupled to the fixed portion and rotatable relative to the fixed portion about a first axis, wherein the rotatable portion is also translatable non-rotationally along the first axis relative to the fixed portion to selectively extend and retract the handle; and a wrench head including at least one contact surface, the wrench head moveable about a second axis transverse to the first axis based upon rotation of the rotatable portion.

17. The wrench of claim 16 wherein the wrench head is a moveable one of an upper jaw and a lower jaw, the moveable one pivoting about the second axis based upon rotation of the rotatable portion of the handle.

18. The wrench of claim 16 wherein the second axis is generally perpendicular to the first axis.

19. A wrench comprising:

a handle having a fixed portion and a rotatable portion, the rotatable portion rotatable about an axis through the handle;

a first jaw mounted to the handle, the first jaw having a first contact surface; and a second jaw mounted to the handle, the second jaw having a second contact surface, generally parallel to the first contact surface, rotation of the rotatable portion of the handle causing relative movement between the first jaw and second jaw, wherein a movable one of the first and second jaws translates relative to the rotatable handle portion in a direction perpendicular to the first and second contact surfaces and generally perpendicular to the axis based upon rotation of the rotatable handle portion.

20. A wrench comprising:

a handle having a fixed portion and a rotatable portion, the rotatable portion rotatable about an axis through the handle, wherein the rotatable portion is also translatable non- rotationally along the first axis relative to the fixed portion to selectively extend and retract the handle;

a first jaw mounted to the handle;

a second jaw mounted to the handle, rotation of the rotatable portion of the handle causing relative movement between the first jaw and second jaw toward or away from one another; and a resilient member biasing one of the first jaw and the second jaw toward the other.

21. A wrench comprising:

a handle having a fixed portion and a rotatable portion rotatable about a first axis relative to the fixed portion;

a wrench head including at least one contact surface; and a flexible cable mechanically interposed between the rotatable portion and the at least one contact surface such that rotation of the rotatable portion of the handle relative to the fixed portion of the handle causes rotational movement of the at least one contact surface relative to the fixed portion of the handle about a second axis transverse to the first axis.

22. The wrench of claim 21 wherein the rotatable portion is also translatable non-rotationally along the first axis relative to the fixed portion to selectively extend and retract the handle.

23. The wrench of claim 21 further including a gear driven by rotation of the flexible cable and rotatable driving the wrench head.

24. The wrench of claim 23 wherein rotation of the handle is capable of completely rotating the wrench head repeatedly.

25. The wrench of claim 20 wherein the second jaw is movable relative to the fixed portion of the handle based upon rotation of the rotatable portion of the handle.

26. The wrench of claim 25 wherein the resilient member biases the first jaw toward the second jaw.

27. The wrench of claim 25 wherein the resilient member biases the second jaw toward the first jaw.

28. The wrench of claim 25 wherein the direction is generally perpendicular to the axis.

29. The wrench of claim 19 wherein the rotatable portion of the handle is also translatable along the axis relative to the fixed portion to selectively extend and retract the handle.

30. The wrench of claim 19 wherein the first and second contact surfaces remain parallel to one another as the movable one of the first and second jaws translates.

* * * * *

UNITED STATES PATENT AND TRADEMARK OFFICE

CERTIFICATE OF CORRECTION

PATENT NO. : 8,176,816 B2
APPLICATION NO. : 11/448600
DATED : May 15, 2012
INVENTOR(S) : David A. Simon It is certified that error appears in the above-identified patent and that said Letters Patent is hereby corrected as shown below:

IN THE CLAIMS:

Claim 19, column 6, lines 66-67: delete "generally perpendicular to the axis"

Signed and Sealed this
Eleventh Day of September, 2012

David J. Kappos

David J. Kappos
*Director of the United States Patent and Trademark Office*